US009303863B2

(12) United States Patent
Vaidya

(10) Patent No.: US 9,303,863 B2
(45) Date of Patent: Apr. 5, 2016

(54) INTEGRATED LIGHT AND MICROPHONE SYSTEM

(71) Applicant: Shure Acquisition Holdings, Inc., Niles, IL (US)

(72) Inventor: Avinash K. Vaidya, Riverwoods, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 180 days.

(21) Appl. No.: 14/104,741

(22) Filed: Dec. 12, 2013

(65) Prior Publication Data

US 2015/0167956 A1 Jun. 18, 2015

(51) Int. Cl.

| | |
|---|---|
| ***F21V 33/00*** | (2006.01) |
| ***F21V 14/02*** | (2006.01) |
| ***H04R 29/00*** | (2006.01) |
| ***H04R 1/08*** | (2006.01) |
| *H04R 1/40* | (2006.01) |

(52) U.S. Cl.

CPC ..... *F21V 33/0056* (2013.01); *F21V 14/02* (2013.01); *H04R 1/083* (2013.01); *H04R 29/004* (2013.01); *H04R 1/406* (2013.01)

(58) Field of Classification Search

CPC ..... H04R 3/005; H04R 1/406; H04R 1/08; H04R 2430/20; H04R 2430/23; H04R 2499/11; H04R 5/027; H04R 1/326

USPC ..... 360/92

See application file for complete search history.

(56) References Cited

U.S. PATENT DOCUMENTS

| | | | | |
|---|---|---|---|---|
| 5,625,697 | A | 4/1997 | Bowen et al. | |
| 8,170,260 | B2 * | 5/2012 | Reining et al. | 381/369 |
| 2004/0122602 | A1 | 6/2004 | Nagase | |
| 2008/0144876 | A1 | 6/2008 | Reining et al. | |
| 2013/0155419 | A1 | 6/2013 | Atkinson et al. | |

OTHER PUBLICATIONS

International Search Report and Written Opinion for PCT/US2014/069728 dated Feb. 23, 2015 (8 pp.).

* cited by examiner

*Primary Examiner* — Mark Blouin

(74) *Attorney, Agent, or Firm* — William J. Lenz, Esq.; Neal, Gerber & Eisenberg LLP

(57) ABSTRACT

Integrated light and microphone systems are provided that include a microphone with directionality and a lighting device that emits a light beam. The light beam may be emitted in a direction substantially the same as the directionality of the microphone. The lighting device and the microphone can share a common interference tube to assist in aligning the directionalities of the microphone and the lighting device. The systems may be adjusted to enable visual calibration of the microphone to optimally detect sound from an audio source. The audio source can be simultaneously illuminated. The systems may be unobtrusive and more easily used to meet the aesthetic needs of an environment. Multiple integrated light and microphone systems can be in communication with an audio mixer to optimally detect sounds from multiple audio sources and create a desired audio mix that emphasizes a target audio source and suppresses other audio sources.

19 Claims, 4 Drawing Sheets

INTEGRATED LIGHT AND MICROPHONE SYSTEM

TECHNICAL FIELD

This application generally relates to an integrated light and microphone system. In particular, this application relates to a system including a lighting device capable of emitting a light beam in a direction substantially the same as the directionality of a microphone.

BACKGROUND

Conferencing environments, such as boardrooms, video conferencing settings, and the like, can involve the use of microphones for capturing sound from audio sources. The audio sources may include human speakers, for example. The captured sound may be disseminated to an audience through speakers in the environment, a telecast, and/or a webcast. In some environments, the microphones may be placed on a table or lectern near the audio source in order to capture the sound. However, such microphones may be obtrusive or undesirable, due to their size and/or the aesthetics of the environment the microphones are being used in. In addition, microphones placed on a table can detect undesirable noise, such as the shuffling of papers. Microphones placed on a table may also be covered or obstructed, such as by paper, cloth, or napkins, so that the sound is not properly or optimally captured.

In other environments, the microphones may include shotgun microphones that are primarily sensitive to sounds in one direction. The shotgun microphones can be located farther away from an audio source and be directed to detect the sound from a particular audio source by pointing the microphone at the area occupied by the audio source. However, it can be difficult and tedious to determine the direction to point a shotgun microphone to optimally detect the sound coming from its audio source. Trial and error may be needed to adjust the position of the shotgun microphone for optimal detection of sound from an audio source. As such, the sound from the audio source may not be ideally detected unless and until the position of the microphone is properly adjusted.

Accordingly, there is an opportunity for systems that address these concerns. More particularly, there is an opportunity for systems including an integrated microphone and lighting device that is unobtrusive, can enable the adjustment of the microphone to optimally detect sounds from an audio source, and can simultaneously illuminate the audio source, e.g., a human speaker.

SUMMARY

The invention is intended to solve the above-noted problems by providing a system that is designed to, among other things: (1) provide a system including a transducer and a lighting device integrated with the transducer, the lighting device capable of emitting a light beam in a direction substantially the same as the directionality of the transducer; and (2) provide a system including a plurality of transducers; a plurality of lighting devices each integrated with each of the plurality of transducers, each lighting device capable of emitting a light beam in a direction substantially the same as the directionality of the respective transducer; and an audio mixer in communication with the plurality of transducers, the audio mixer for receiving the audio signals, continuously monitoring the audio signals, and determining which of the transducers is active, based on the received audio signals.

In an embodiment, a system may include a transducer for detecting sound from an audio source and converting the sound to an audio signal, where the transducer has a directionality. The system may also include a lighting device integrated with the transducer, where the lighting device is capable of emitting a light beam in a direction substantially the same as the directionality of the transducer.

In another embodiment, a system includes a plurality of transducers each for detecting sound from an audio source and converting the sound to an audio signal, and each transducer having a directionality. The system may also include a plurality of lighting devices each integrated with each of the plurality of transducers, and each lighting device may be capable of emitting a light beam in a direction substantially the same as the directionality of the respective transducer. The system may further include an audio mixer in communication with each of the plurality of transducers, and the audio mixer may be for receiving each of the audio signals, continuously monitoring the audio signals, and determining which of the plurality of transducers is active, based on the received audio signals.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
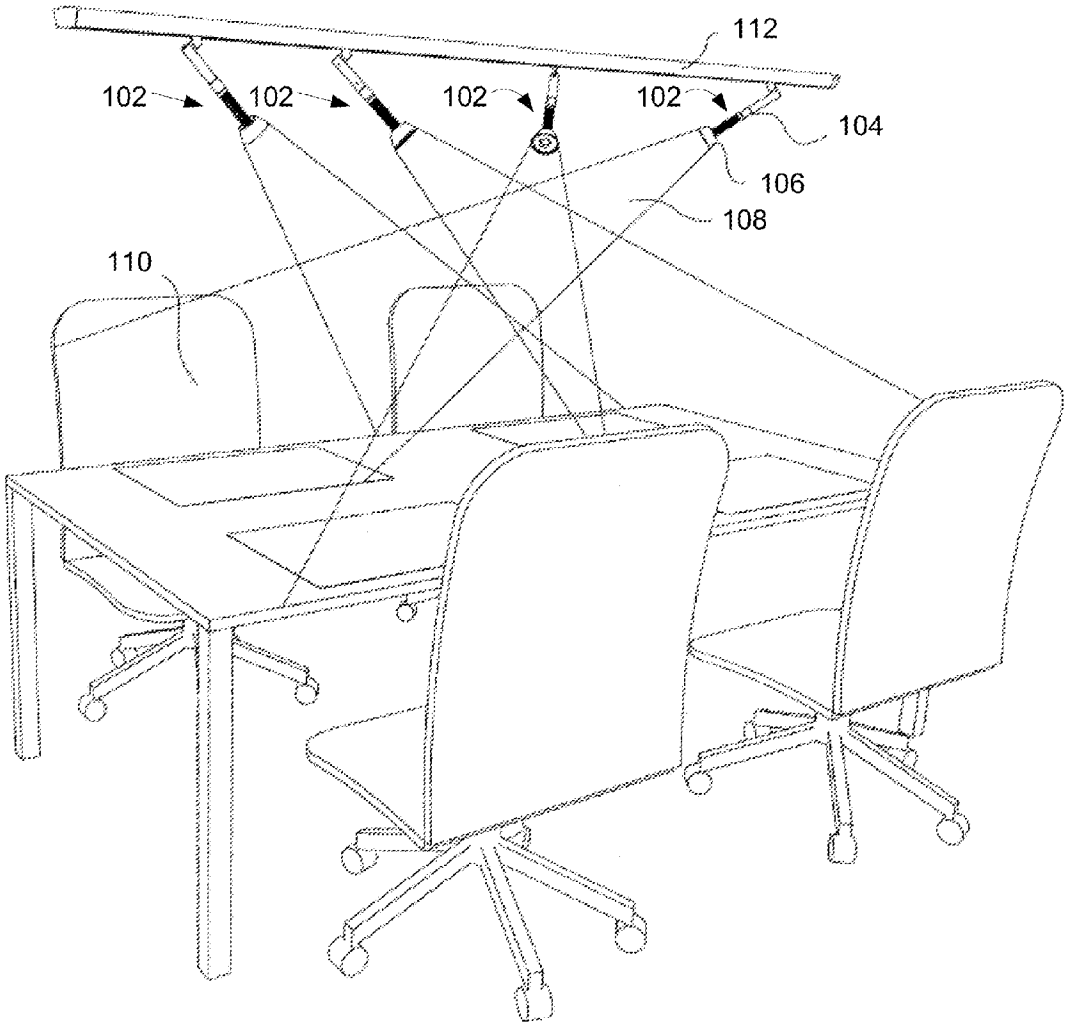
FIG. 1 is an exemplary environment including integrated microphone and lighting device units, in accordance with some embodiments.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

The systems described below can assist in the adjustment of a microphone to optimally detect sound from an audio source. The integrated microphone and lighting device systems allow easier visual calibration of the microphone by enabling the systems to be quickly adjusted to optimally detect sounds from an audio source. In particular, the lighting device may emit a light beam in a direction that is substantially the same as a directionality of the microphone, and the light beam may assist in optimally adjusting the microphone. Furthermore, by integrating a microphone and the lighting device, the system may be more unobtrusive than other types of microphones while also being able to illuminate the audio source, e.g., a human speaker. Most human speakers are likely to accept an overhead lighting device as necessary for providing illumination, but may object to having a large microphone mounted overhead as a separate device. Therefore, combining a microphone and lighting device in the same system, e.g., in a common tube, can be cost-effective and service the objectives of capturing sound and providing illumination in an aesthetically pleasing manner.

FIG. 1 illustrates an exemplary environment including integrated microphone and lighting device units 102. The environment may be a conferencing environment, for example, such as a boardroom where microphones are utilized to capture sound from audio sources such as human speakers. In the exemplary environment shown in FIG. 1, human speakers (not shown) may be seated in chairs 110 at a table, although other physical configurations and placements of the audio sources are contemplated and possible. The microphone and lighting device units 102 are shown in FIG. 1 as already adjusted such that they are pointing at the chairs 110 where the audio sources would likely be situated, in order to optimally detect and capture sounds from the audio sources.

Microphones 104 in the microphone and lighting device units 102 may detect and capture sounds in the environment from audio sources, such as, for example, speech spoken by speakers sitting in the chairs 110. The sounds travel from the audio sources to the microphones 104. In one embodiment, the microphones 104 may be unidirectional microphones that are primarily sensitive in one direction, such as shotgun microphones. In other embodiments, the microphones 104 may have other directionalities or polar patterns, such as omnidirectional, cardioid, subcardioid, etc., as desired. The microphones 104 may be any suitable transducer that can detect the sound from an audio source and convert the sound to an electrical audio signal. For example, the microphones 104 may be condenser microphones, electret microphones, dynamic microphones, ribbon microphones, piezoelectric microphones, and/or other types of microphones.

Lighting devices 106 in each of the microphone and lighting device units 102 may emit a light beam 108 that can illuminate the area of each of the audio sources, such as speakers sitting in the chairs 110. The light beams 108 may serve the purposes of illuminating the audio source (e.g., to focus an audience's attention on the speaker) and to ensure that the microphones 104 are properly adjusted to optimally detect sounds from the audio source. In particular, the direction of each light beam 108 emitted by a lighting device 106 may be substantially the same as the directionality of each microphone 104. The light beams 108 travel from the lighting devices 106 to the audio source. The lighting devices 106 may be integrated with the microphones 104 in the units 102 as separate components or be combined together. A suitable housing may also be used to contain the microphones 104 and the lighting devices 106 in the units 102. In one embodiment, the lighting devices 106 may include one or more light-emitting diodes. In other embodiments, the lighting devices 106 may be include any suitable light source, such as incandescent lights, halogen lamps, fluorescent lamps, arc lamps, and/or other types of lights or lamps. In embodiments where the microphones 104 are unidirectional, such as shotgun microphones, the microphones 104 and the lighting devices 106 may share a common interference tube (also known as a shotgun barrel) such that the sound and the light beam 108 do not interfere with each other because of the significant differences in the frequencies of the sound and the light beam 108. The common interference tube can also assist in aligning the directionalities of the microphone 104 and the lighting device 106.

The microphone and lighting device units 102 are shown in FIG. 1 as installed on a track 112 situated on (or suspended from) the ceiling of the environment and overhead the center of a table. The track 112 can be shaped in any configuration or format, such as single strip, oval, u-shape, circle, square, rectangle, etc., based on the number of positions or chairs around the table, the size of the table, and/or other factors, in order to have an optimal aesthetically pleasing setup. While the track 112 in FIG. 1 is shown overhead in the environment, the microphone and lighting device units 102 may be installed in other suitable locations in a particular environment. Because calibration of the position of the microphones 104 in the units 102 is eased by using the lighting devices 106, the units 102 may be installed and placed in any suitable location to meet the aesthetic needs of an environment. Regardless of the location(s) where the microphone and lighting device units 102 are installed, the units 102 may be manually or automatically adjusted so that the light beam 108 emitted by a lighting device 106 illuminates the audio source and provides visual confirmation that the microphone 104 is directed at the audio source. In some embodiments, the microphone 104 and the lighting device 106 may be independently activated or deactivated. For example, if the audio source does not need to be illuminated after the microphone has been adjusted, then the lighting device 106 can be deactivated.

The track 112 shown in the exemplary embodiment of FIG. 1 may include wiring for electrical power to the microphones 104 and lighting devices 106 of the microphone and lighting device units 102. The track 112 may also include wiring and/or wireless components for conveying the audio signals from the microphones 104 to an audio recorder, audio mixer, amplifier, and/or other component for processing of the audio signals. Wired and/or wireless components may also be included in the track 112 for remote control and configuration of the microphone and lighting device units 102. The microphone and lighting device units 102 may be physically mounted to the track 112 using any suitable means.

Figure 2:
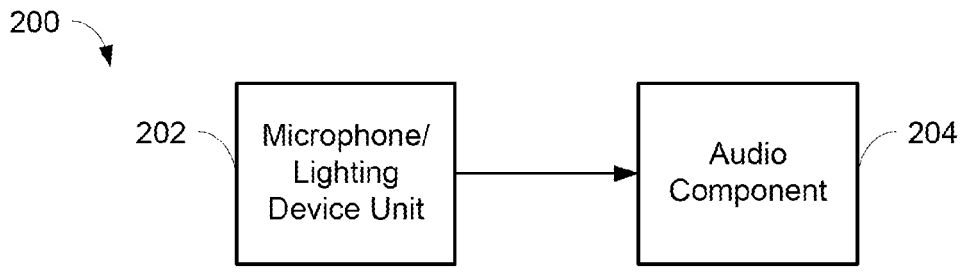
FIG. 2 is a block diagram of an exemplary audio system including an integrated microphone and lighting device unit and an audio component, in accordance with some embodiments.

FIG. 2 illustrates a block diagram of an exemplary audio system 200 including a microphone and lighting device unit 202 and an audio component 204. The microphone and lighting device unit 202 may be configured as the microphone and lighting device unit 102 shown in FIG. 1, for example, or may be in other configurations. A microphone and a lighting device may be included in the microphone and lighting device unit 202. In the audio system 200 of FIG. 2, the microphone and lighting device unit 202 may be in wired or wireless communication with the audio component 204 that receives audio signals from the microphone in the microphone and lighting device unit 202. The audio component 204 may be an audio recorder, audio mixer, amplifier, and/or other component for processing of the audio signals.

Figure 3:
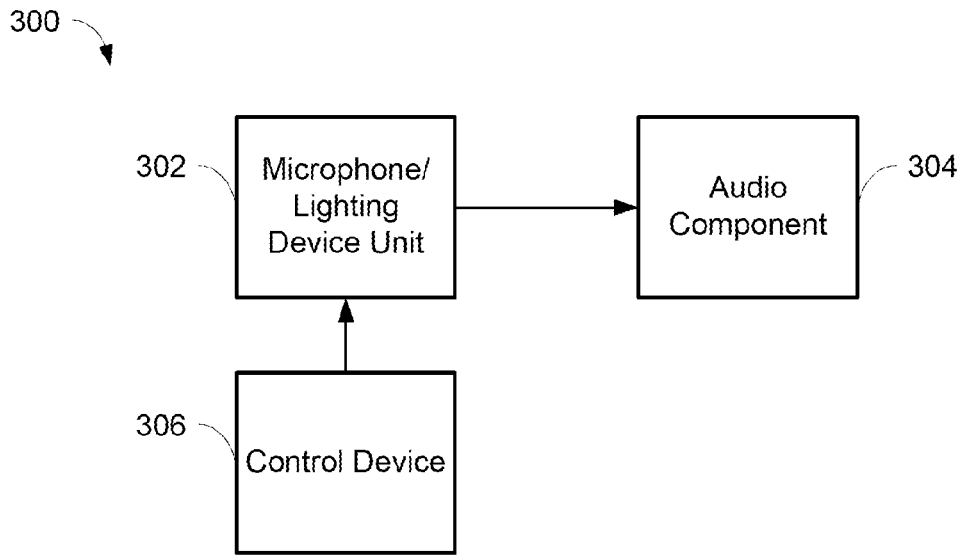
FIG. 3 is a block diagram of an exemplary audio system including an integrated microphone and lighting device unit, an audio component, and a control device, in accordance with some embodiments.

FIG. 3 illustrates a block diagram of an exemplary audio system 300 including a microphone and lighting device unit 302, an audio component 304, and a control device 306. The microphone and lighting device unit 302 may be configured as the microphone and lighting device unit 102 shown in FIG. 1, for example, or may be in other configurations. A microphone and a lighting device may be included in the microphone and lighting device unit 302. In the audio system 300 of FIG. 3, the microphone and lighting device unit 302 may be in wired or wireless communication with the audio component 304 that receives audio signals from the microphone in the microphone and lighting device unit 302. The audio component 304 may be an audio recorder, audio mixer, amplifier, and/or other component for processing of the audio signals.

The control device 306 may be in wired or wireless communication with the microphone and lighting device unit 302 to control the unit 302, the microphone, and/or the lighting device. For example, the control device 306 may include controls to enable physical positioning of the unit 302 to adjust the direction of the microphone and lighting device, as desired. The control device 306 may also include controls to activate or deactivate the microphone and/or the lighting device. Controls on the control device 306 may further enable the adjustment of parameters of the microphone, such as directionality, gain, noise suppression, pickup pattern/directionality, muting, frequency response, etc., and/or parameters of the lighting device, such as the intensity of the light beam, flashing capabilities, color, focus characteristics (e.g., spotlight, floodlight), etc. In embodiments, the control device 306 may be a laptop computer, desktop computer, tablet computer, smartphone, proprietary device, and/or other type of electronic device. In other embodiments, the control device 306 may include one or more switches, dimmer knobs, buttons, and the like.

Figure 4:
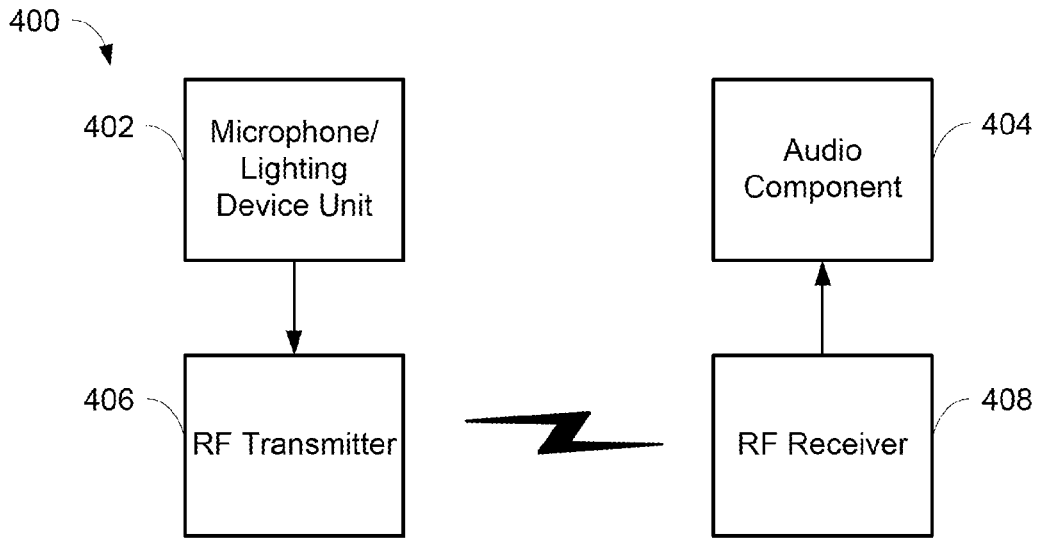
FIG. 4 is a block diagram of an exemplary audio system including an integrated microphone and lighting device unit, a radio frequency (RF) transmitter, an RF receiver, and an audio component, in accordance with some embodiments.

FIG. 4 illustrates a block diagram of an exemplary audio system 400 including a microphone and lighting device unit 402, a radio frequency (RF) transmitter 406, an RF receiver 408, and an audio component 404. The microphone and lighting device unit 402 may be configured as the microphone and lighting device unit 102 shown in FIG. 1, for example, or may be in other configurations. A microphone and a lighting device may be included in the microphone and lighting device unit 402. In the audio system 400 of FIG. 4, the microphone and lighting device unit 402 may be in wireless communication with the audio component 404 that receives audio signals from the microphone in the microphone and lighting device unit 402. The audio component 404 may be an audio recorder, audio mixer, amplifier, and/or other component for processing of the audio signals.

The wireless communication between the microphone and lighting device unit 402 and the audio component 404 may be facilitated by the RF transmitter 406 and the RF receiver 408 that transmit and receive an RF signal, respectively. The RF signal may be an analog or digital modulated signal and contain the audio signal from the microphone of the microphone and lighting device unit 402. In particular, the RF transmitter 406 may modulate the audio signal from the microphone into the RF signal, and transmit the RF signal. The RF receiver 408 may receive the transmitted RF signal and demodulate the RF signal to recover the audio signal. The RF receiver 408 may then transmit the audio signal to the audio component 404. The RF transmitter 406 and the RF receiver 408 may be synchronized so that the same frequency is utilized for communication between the components.

Figure 5:
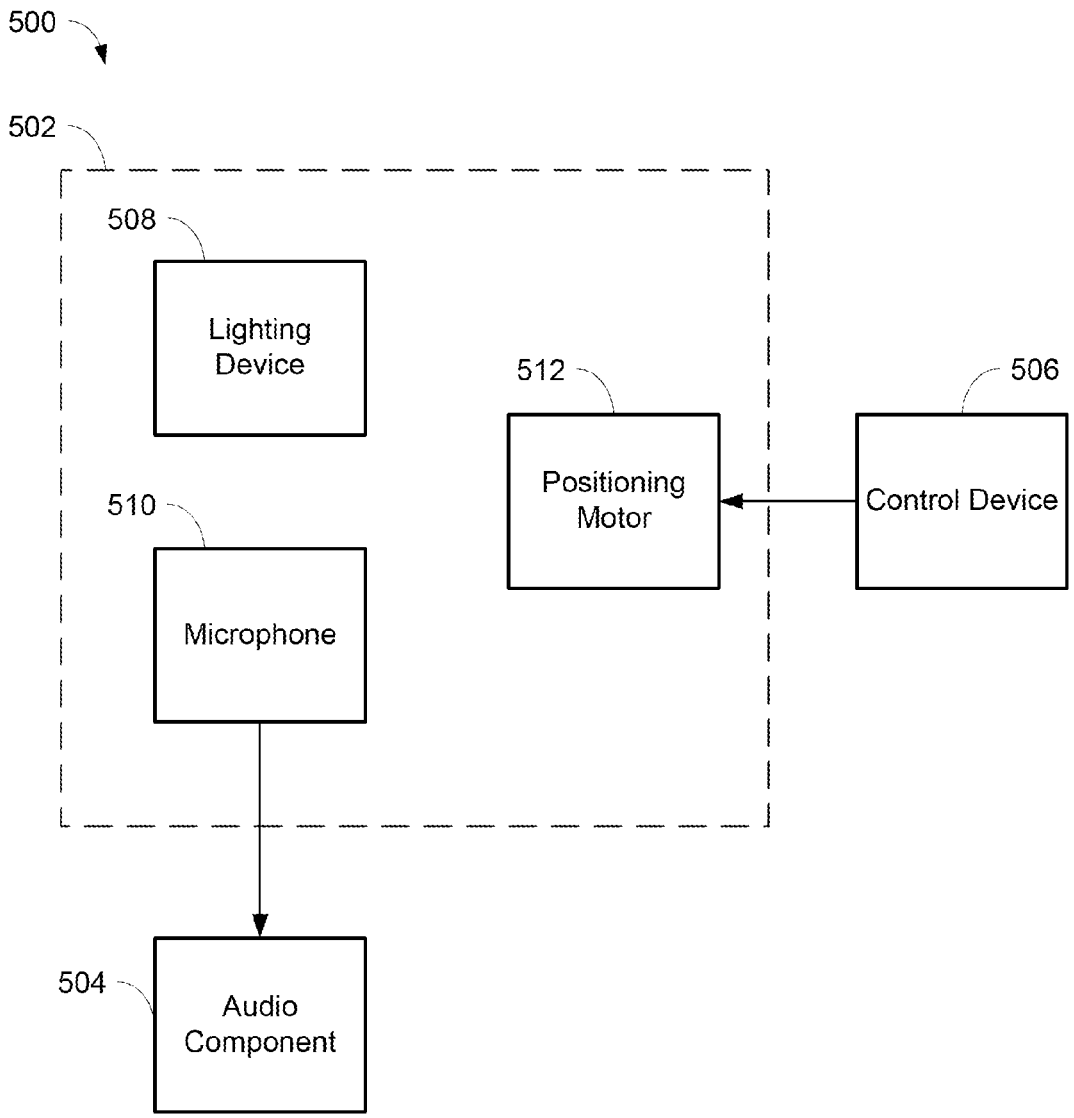
FIG. 5 is a block diagram of an exemplary audio system including an integrated microphone and lighting device unit, a positioning motor, a control device, and an audio component, in accordance with some embodiments.

FIG. 5 illustrates a block diagram of an exemplary audio system 500 including n microphone and lighting device unit 502 with a lighting device 508, microphone 510, and positioning motor 512; a control device 506; and an audio component 504. The microphone and lighting device unit 502 may be configured as the microphone and lighting device unit 102 shown in FIG. 1, for example, or may be in other configurations. In the audio system 500 of FIG. 5, the microphone 510 may be in wired or wireless communication with the audio component 504 that receives audio signals from the microphone 510. The audio component 504 may be an audio recorder, audio mixer, amplifier, and/or other component for processing of the audio signals.

The control device 506 may be in wired or wireless communication with the positioning motor 512 in the microphone and lighting device unit 502. The positioning motor 512 may adjust the physical position of the microphone and lighting device unit 502 and be controlled through the control device 506. In particular, the direction of the lighting device 508 and the microphone 510 may be adjusted as desired. For example, the lighting device 508 and the microphone 510 may be directed at an audio source, e.g., a human speaker, so that the audio source is illuminated by a light beam emitted by the lighting device 508 and the microphone 510 optimally detects sounds from the audio source. As the audio source moves, the positioning motor 512 can be controlled to adjust the physical position of the microphone and lighting device unit 502 so that the audio source continues to be illuminated by the lighting device 508 and the microphone 510 continues to optimally detect sounds from the audio source. In embodiments, the control device 506 may be a laptop computer, desktop computer, tablet computer, smartphone, proprietary device, and/or other type of electronic device.

Figure 6:
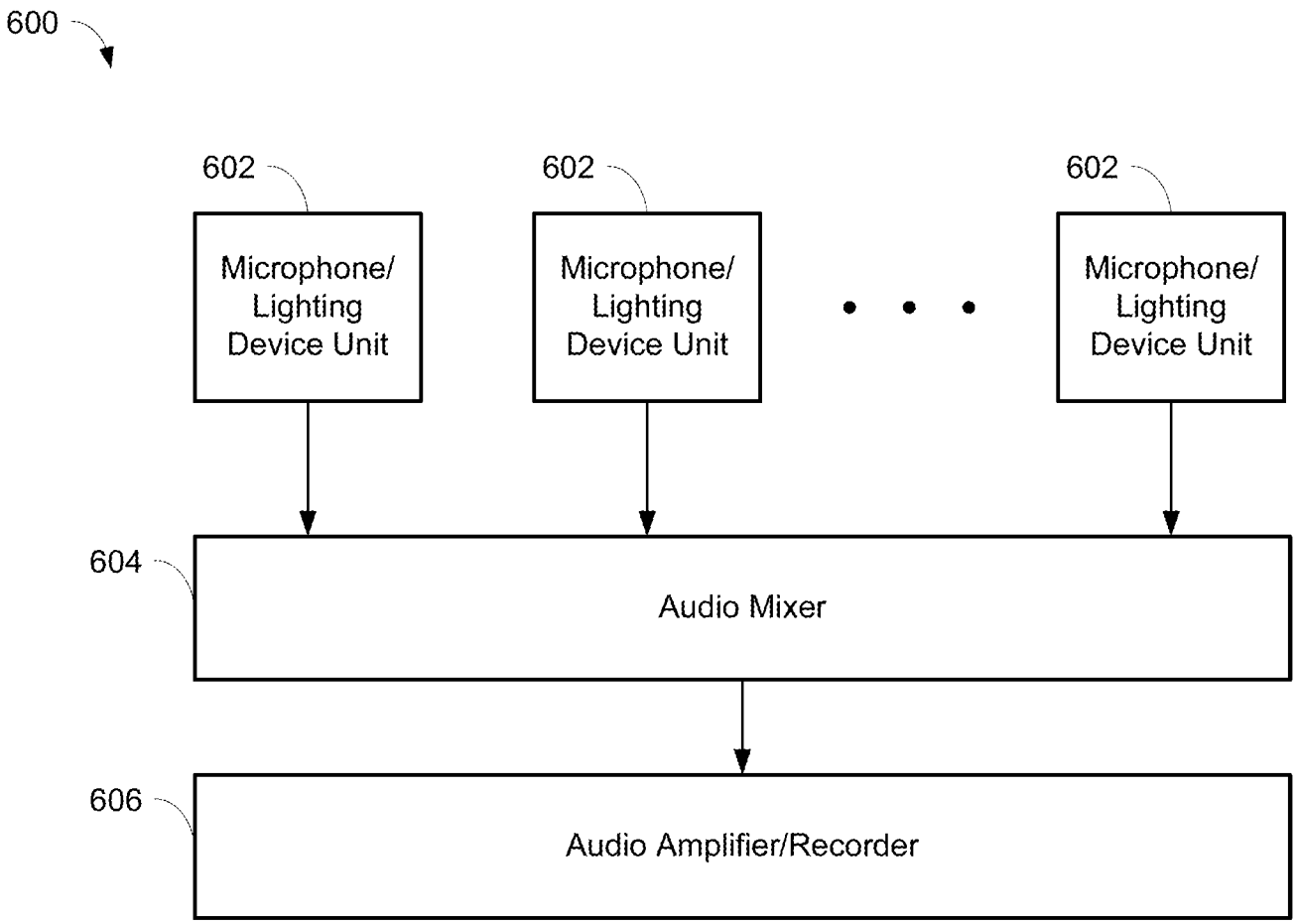
FIG. 6 is a block diagram of an exemplary audio system including a plurality of integrated microphone and lighting device units, an audio mixer, and an audio amplifier/recorder.

FIG. 6 is a block diagram of an exemplary audio system 600 including multiple integrated microphone and lighting device units 602, an audio mixer 604, and an audio amplifier/recorder 606. Each of the microphone and lighting device units 602 may be configured as the microphone and lighting device unit 102 shown in FIG. 1, for example, or may be in other configurations. In the audio system 600 of FIG. 6, each of the microphone and lighting device units 602 may be in wired or wireless communication with the audio mixer 604 that receives audio signals from the microphones of the microphone and lighting device units 602. The audio mixer 604 may be a component that enables the mixing of the audio signals (e.g., combining, routing, changing, and/or otherwise manipulating the audio signals). In some embodiments, the audio mixer 604 can be a laptop computer, desktop computer, tablet computer, smartphone, or other electronic device for mixing the audio signals.

The audio mixer 604 may continuously monitor the received audio signals from each microphone in the microphone and lighting device units 602 and determine which microphone(s) should be active. In an embodiment, one or more of the microphones in the microphone and lighting device units 602 may be muted, based on whether the audio signal from a particular microphone is active or inactive. For example, if the sound from an audio source stops, then the particular microphone directed at the audio source will no longer detect the sound. The audio mixer 604 can monitor the audio signal from that particular microphone, determine that the particular microphone is currently inactive, and mute the particular microphone. Conversely, if the sound from an audio source begins or continues, then the particular microphone directed at the audio source will detect the sound. In this case, the audio mixer 604 can monitor the audio signal from that particular microphone and determine that the particular microphone is currently active. In this way, a desired audio mix can be output from the audio mixer 604 such that a targeted audio source is emphasized and the other audio sources are suppressed. Embodiments of audio mixers are disclosed in commonly-assigned patents, U.S. Pat. No. 4,658,425 and U.S. Pat. No. 5,297,210, each of which is incorporated by reference in its entirety.

The audio mixer 604 may be in wired or wireless communication with the audio amplifier/recorder 606. The audio amplifier/recorder 606 may receive a signal from the audio mixer 604 after the audio mixer 604 has determined which of the audio signals from the microphone and lighting device units 602 is active. The audio amplifier/recorder 606 may be a component that amplifies the received signal for output to a loudspeaker, headphones, etc. and/or records the received signal onto a medium, such as flash memory, hard drives, solid state drives, tapes, optical media, etc. For example, the audio amplifier/recorder 606 may disseminate the sound to an audience through loudspeakers.

FIGS. 2-6 described above are exemplary embodiments of systems including microphone and lighting device units. The connections between the components shown in FIGS. 2-6 are intended to depict the potential flow of control signals, audio signals, and/or other signals over wired and/or wireless communication links. Such signals may be in digital and/or analog formats.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. A system, comprising:

a transducer for detecting sound from an audio source and converting the sound to an audio signal, the transducer having a directionality; and a lighting device integrated with the transducer, the lighting device capable of emitting a light beam in a direction substantially the same as the directionality of the transducer;

wherein the transducer and the lighting device are mechanically adjustable simultaneously to direct the light beam to illuminate an area associated with the audio source.

2. The system of claim 1, wherein the transducer comprises a unidirectional microphone.

3. The system of claim 1, wherein the lighting device comprises one or more of a light-emitting diode, a halogen light, a fluorescent light, or an incandescent light.

4. The system of claim 1, wherein the lighting device is capable of illuminating the area associated with the audio source such that the transducer optimally detects the sound.

5. The system of claim 1, further comprising a common tube having the transducer and the lighting device disposed within.

6. The system of claim 1, wherein the transducer is in communication with one or more of an audio recorder or an audio mixer for receiving the audio signal.

7. The system of claim 1, further comprising a wireless audio transmitter in communication with the transducer, the wireless audio transmitter for modulating the audio signal into a radio frequency (RF) signal and wirelessly transmitting the RF signal to a wireless audio receiver.

8. The system of claim 7, wherein the wireless audio receiver is in communication with one or more of an audio recorder or an audio mixer, the wireless audio receiver for wirelessly receiving the RF signal, demodulating the RF signal into a second audio signal, and transmitting the second audio signal to one or more of the audio recorder or the audio mixer.

9. The system of claim 1, further comprising a positioning motor configured to physically adjust a position of the lighting device, the transducer, and the direction of the light beam.

10. The system of claim 9, further comprising a control device in communication with the positioning motor, the control device for enabling control of the positioning motor.

11. The system of claim 1, further comprising a housing for containing the transducer and the lighting device.

12. The system of claim 1, wherein the light beam emitted by the lighting device can be activated or deactivated independently of whether the transducer is activated or deactivated.

13. The system of claim 1, further comprising a control device in communication with the lighting device and the transducer, the control device for enabling activation or deactivation of the light beam emitted by the lighting device and enabling activation or deactivation of the transducer.

14. A system, comprising:

a plurality of transducers each having a directionality, each of the plurality of transducers for detecting sound from an audio source and converting the sound to an audio signal;

a plurality of lighting devices each integrated with each of the plurality of transducers, each of the plurality of lighting devices capable of emitting a light beam in a direction substantially the same as the directionality of the respective transducer; and an audio mixer in communication with each of the plurality of transducers, the audio mixer for receiving each of the audio signals, continuously monitoring the audio signals, and determining which of the plurality of transducers is active, based on the received audio signals;

wherein each of the plurality of transducers and each of the plurality of lighting devices are mechanically adjustable simultaneously to direct the respective light beam to illuminate an area associated with the audio source.

15. The system of claim 14, wherein each of the plurality of transducers comprises a unidirectional microphone.

16. The system of claim 14, wherein each of the plurality of lighting devices comprises one or more of a light-emitting diode, a halogen light, a fluorescent light, or an incandescent light.

17. The system of claim 14, wherein each of the plurality of lighting devices is capable of illuminating the area associated with the audio source such that the respective transducer optimally detects the sound.

18. The system of claim 14, further comprising a plurality of common tubes each having one of the plurality of transducers and one of the plurality of lighting devices disposed within.

19. The system of claim 14, wherein the light beam emitted by each of the plurality of lighting devices can be activated or deactivated independently of whether the respective transducer is activated or deactivated.

* * * * *